US007648449B1

(12) United States Patent
Detert

(10) Patent No.: US 7,648,449 B1
(45) Date of Patent: Jan. 19, 2010

(54) AQUATIC EXERCISE DEVICE

(76) Inventor: Ryan Detert, 7063 Valencia Dr., Boca Raton, FL (US) 33433

( * ) Notice: Subject to any disclaimer, the term of this patent is extended or adjusted under 35 U.S.C. 154(b) by 0 days.

(21) Appl. No.: 11/621,795

(22) Filed: Jan. 10, 2007

(51) Int. Cl.
*A63B 21/008* (2006.01)
*A63B 31/00* (2006.01)
*B63C 9/08* (2006.01)
*A63G 31/00* (2006.01)

(52) U.S. Cl. ..... 482/111; 482/55; 441/129; 472/129

(58) Field of Classification Search ..... 482/23, 482/55, 111; 472/129; 441/136, 35, 65, 441/129; 4/496
See application file for complete search history.

(56) References Cited

U.S. PATENT DOCUMENTS

| | | | | | |
|---|---|---|---|---|---|
| 228,671 | A | | 6/1880 | Palmer | |
| 3,042,945 | A | * | 7/1962 | Saeman | 441/135 |
| D199,470 | S | * | 10/1964 | Ziff | D21/770 |
| 3,183,530 | A | * | 5/1965 | Girden | 441/65 |
| 3,714,921 | A | * | 2/1973 | Gibson | 441/64 |
| 4,439,165 | A | * | 3/1984 | Rothstein | 441/74 |
| 4,443,204 | A | * | 4/1984 | Perrin | 441/129 |
| 4,634,393 | A | * | 1/1987 | Wood | 441/129 |
| 4,666,414 | A | * | 5/1987 | Fox et al. | 441/129 |
| 4,768,774 | A | | 9/1988 | Beasley | |
| 4,781,638 | A | * | 11/1988 | Winters, Jr. | 441/129 |
| 4,932,912 | A | * | 6/1990 | Combs | 441/129 |
| 4,973,279 | A | * | 11/1990 | Baumann | 441/135 |
| 5,090,695 | A | * | 2/1992 | Ciolino | 482/142 |
| 5,106,078 | A | | 4/1992 | Rowe | |
| 5,149,314 | A | * | 9/1992 | Ciolino et al. | 482/111 |
| 5,273,470 | A | * | 12/1993 | Sneddon et al. | 441/65 |
| 5,314,395 | A | * | 5/1994 | Ciolino | 482/111 |
| 5,324,221 | A | * | 6/1994 | Kaufman et al. | 441/129 |
| D355,465 | S | * | 2/1995 | Davies | D21/809 |

(Continued)

FOREIGN PATENT DOCUMENTS

| | | |
|---|---|---|
| DE | 19617720 | 11/1997 |

(Continued)

OTHER PUBLICATIONS

Kolbeck, A G., H Fujimoto, D R. Uhlmann, and P D. Calvert. "Gas-Filled Polymers. III. Mechanical Behavior of Polycarbonate and Poly(Vinyl Chloride)." Journal of Applied Polymer Science 17 (1973): 2395-2405.*

(Continued)

*Primary Examiner*—Tatyana Zalukaeva
*Assistant Examiner*—Sandhara M Ganesan
(74) *Attorney, Agent, or Firm*—Michael I Kroll

(57) ABSTRACT

The present invention relates to a floating exercise mat. The mat has a substantially planar surface with distal and proximal ends. The mat has a headrest secured to the proximal end. The headrest is thicker than the body of the mat to support the head of a user. The body of the mat has two apertures therein, where each aperture has a handle disposed therein. The handles provide the user a gripping surface so that the user can perform exercises when gripping the floating mat. The distal end of the body of the mat has resistance wings secured thereon. The resistance wings can be made of a rigid material such as polycarbonate. The wings can be in the shape of a oval, triangle, semicircle, triangle, or a rectangle.

1 Claim, 10 Drawing Sheets

U.S. PATENT DOCUMENTS

| | | | | |
|---|---|---|---|---|
| 5,447,459 | A * | 9/1995 | Hammond | 441/135 |
| 5,498,184 | A * | 3/1996 | Saghri | 441/65 |
| 5,514,057 | A | 5/1996 | Ciolino | |
| 5,833,505 | A * | 11/1998 | Huang | 441/129 |
| 6,843,695 | B1 | 1/2005 | Jackson et al. | |
| 6,887,186 | B2 * | 5/2005 | Bambanian | 482/55 |
| 2005/0202738 | A1 * | 9/2005 | Lee et al. | 441/65 |

FOREIGN PATENT DOCUMENTS

| | | | |
|---|---|---|---|
| FR | 2751610 | | 1/1998 |
| GB | 1397456 | A * | 6/1975 |
| GB | 2288337 | A * | 10/1995 |
| JP | 3178676 | | 8/1991 |
| JP | 2000335484 | A * | 12/2000 |
| WO | WO9014863 | | 12/1990 |

OTHER PUBLICATIONS

Schaeffer, Charles, Kathryn Brown Ramsperger, and Suzan Richmond. "Biking with a Child in Back; Space-Age Fillings' Water Workouts That Work. (Health and Fitness)." Changing Times Apr. 1989: 118-119. Gale Group Magazine DB. Mar. 28, 2008.*

"Aquatic Sports (Self-Help Devices for Water Activities)." The Exceptional Parent Jul. 1993: 30-31. TGG Health&Wellness DB. Mar. 27, 2008.*

* cited by examiner

AQUATIC EXERCISE DEVICE

BACKGROUND OF THE INVENTION

1. Field of the Invention

The present invention relates generally to aquatic devices and, more specifically, to an aquatic exercise flotation mat having a plurality of handles and an extending form whereby the user may perform an abdominal exercise by grasping said handles and lifting one's legs under the device to work their abdominals or in combination swinging the lifted legs side to side to target the obliques and hip flexor region of the lower body. Additionally on at least one end a plurality of appropriately angled Plexiglas® resistance elements present water resistance and provide stability to the device while the user is performing an exercise.

2. Description of the Prior Art

There are other aquatic devices designed for performing exercises. Typical of these is U.S. Pat. No. 228,671 issued to Palmer on Jun. 8, 1880.

Another patent was issued to Gibson on Feb. 6, 1973 as U.S. Pat. No. 3,714,921. Yet another U.S. Pat. No. 4,768,774 was issued to Beasley on Sep. 6, 1988 and still yet another was issued on Feb. 25, 1992 to Peter A. Ciolino as U.S. Pat. No. 5,090,695.

Another patent was issued to 5,106,078 on Apr. 21, 1992 as U.S. Pat. No. 5,106,078. Yet another U.S. Pat. No. 5,149,314 was issued to Ciolino et al on Sep. 22, 1992. Another was issued to Ciolino on May 7, 1996 as U.S. Pat. No. 5,514,057 and still yet another was issued on Jan. 18, 2005 to Jackson et al. as U.S. Pat. No. 6,843,695.

Another patent was issued to Ciolino on Dec. 13, 1990 as PCT. Patent No. WO9014863 Yet another Japanese. Patent No. JP3178676 was issued to Hideaki on Aug. 2, 1991. Another was issued to Bartosch on Nov. 6, 1997 as German Patent No. DE19617720 and still yet another was issued on Jan. 30, 1998 to Cosnefroy as French Patent No. FR2751610

U.S. Pat. No. 228,671

Inventor: B. Palmer

Issued: Jun. 8, 1880

In a combined mattress an life preserver of the nature and construction herein before described, the combination, with the mattress A, formed in two parts, of the series of elastic bands B, substantially as and for the purpose herein set forth.

U.S. Pat. No. 3,714,921

Inventor: Stan Gibson

Issued: Feb. 6, 1973

A water float leaving a buoyant body portion and buoyant rear paddle portions hinged to the body portion. The two rear paddle portions are connected to the body portion by hinge means and have foot straps secured thereto. Upon lying on the float with the feet connected under the foot straps, a person can produce up and down motion of the paddle portions to propel the float through the water. The paddle portions may be formed integrally with the body portion or may detach therefrom. Fins and flanges may be added to the paddles to increase the propelling efficiency thereof.

U.S. Pat. No. 4,768,774

Inventor: Bob L. Beasley

Issued: Sep. 6, 1988

An aquatic exercise device for use in a swimming pool or the like comprising a substantially columnar-shaped, flexible buoyant body having a first and second end and partially encircles and supports the user's body and a substantially shank-type handgripping means integrally attached and projecting endwise outwardly above and below at the first and seconds ends of the substantially columnar-shaped flexible buoyant body thereby enabling the user to perform body movements in an aquatic environment similar to movements on land of walking, running, cycling, cross-country skiing, and calisthenics and further providing enhanced exercise intensity due to the aquatic resistance to movement of the user. The exercise apparatus further embraces an attachment means to grasp the first and second ends of the exercise apparatus to enable aquatic arm exercise and a fluid resistance means attached to the distal end of the hand-gripping means to increase the resistance of the exercise means upon movement in an aquatic exercise environment. The exercise apparatus further embraces an attachment means to accept a series of detachably weighed belts encircling the columnar-shaped, flexible buoyant body. The exercise apparatus further embraces an attachment means to accept a tether on the first and second end handgripping means thereof, whereby the user may secure the exercise apparatus to the body and to a fixed object along the pool side or deck during use to enable stationary exercise during use.

U.S. Pat. No. 5,090,695

Inventor: Peter A. Ciolino

Issued: Feb. 25, 1992

An exercise float platform is formed of specifically dimensioned buoyant sections connected by flexing hinges to permit a user to perform an exercise routine in an aquatic environment. The buoyancy of the individual sections can be selectively adjusted depending on the weight distribution of the individual, or the exercise routine intensity. The exercise float permits the user to perform exercise routines in the water focused on the back, hips and stomach muscle groups along with allowing flexible upper and lower body workouts while either sitting below the water level or reclined above the water level.

U.S. Pat. No. 5,106,078

Inventor: Victor L. Rowe

Issued: Apr. 21, 1992

An aquatic exercising device/apparatus (10) comprising a bed (11) mounted on a frame (12) supported by hollowed columns (13), and lines (17) extending through such columns (13), their one ends attached to floats (16) and their other ends attached to members (30) for or applied to the hands (31) and feet (32) of its user (26). As the user (26) pushes members (30) away, the buoyancy for floats (16) resist their submergence into the water (60) in which apparatus (10) is disposed. Tension thereby is produced for the user's muscles thus exercising them or particular ones. Neck muscles likewise are exercised in another embodiment or assembly (65) which includes a line (67) to which a head harness (66) is fastened, the line extending back to a pulley (71) dependingly mounted on a cross-beam which in turn is mounted to a hollowed standard (68), such line extending through standard (68) to be fastened to a float (16).

U.S. Pat. No. 5,149,314

Inventor: Peter N. Ciolino

Issued: Sep. 22, 1992

An exercise float platform is formed of specifically dimensioned buoyant sections connected by flexing hinges to permit a user to perform an exercise routine in an aquatic environment. The buoyancy of the individual sections can be selectively adjusted depending on the weight distribution of the individual, or the exercise routine intensity. The exercise float permits the user to perform exercise routines in the water focused on the back, hips and stomach muscle groups along with allowing flexible upper and lower body workouts while either sitting below the water level or reclined above the water level. Separate elastic straps are applied to increase the level of resistance during exercise.

U.S. Pat. No. 5,514,057

Inventor: Peter A. Ciolino

Issued: May 7, 1996

Disclosed is a flotation platform engineered to permit aquatic based exercise routines in a conventional bathtub for fitness or rehabilitation, and an exercise method directed to total body strength with focus on stomach and back muscles without undue stress to the lower back, joints and disks of the user.

U.S. Pat. No. 6,843,695

Inventor: Barbara B. Jackson

Issued: Jan. 18, 2005

The water walker assistant is a rectangular shaped buoyant frame with handles for assisting physically challenged individuals walk or float in water. The frame is made of interconnected elongated buoyant members, such as PVC tubing, which are fitted with sections of buoyant foam. The interconnected members define front, rear and side sections of the frame, and the front section is optionally a removable crossbar. The user enters the device by either removing the crossbar or placing the device over his/her body. The water walker assistant features two handles with hand-grips, and cushioned side sections to support the user's forearms inside the device. Elongated members with foam fittings extend from the rear and front of the invention, adding stability to the device, while providing shock absorption in the event of contact with obstacles.

PCT Patent Number WO9014863

Inventor: Peter Ciolino

Issued: Dec. 13, 1990

An exercise float platform is formed of specifically dimensioned buoyant sections connected by flexing hinges to permit a user to perform an exercise routine in an aquatic environment. The buoyancy of the individual sections can be selectively adjusted depending on the weight distribution of the individual, or the exercise routine intensity. The exercise float permits the user to perform exercise routines in the water focused on the back, hips and stomach muscle groups along with allowing flexible upper and lower body workouts while either sitting below the water level or reclined above the water level. Separate elastic straps are applied to increase the level of resistance during exercise.

Japanese Patent Number JP3178676

Inventor: Otaka Hideaki

Issued: Aug. 8, 1991

(To execute various sports or plays by using one piece of water sports floating implement by providing a body whose cross section shows a U-shape, providing a see-through member on the front end side of the body, and forming an opening part allowing stretching of arms and motion on suitable parts of both sides of the body. CONSTITUTION: When arms are inserted into opening parts 3, 3 formed on both sides of a body 1, swimming of a crawl, etc., can be executed without a head and a face are put into water. Or when a see-through member 4 provided on the tip side of the body 1 is utilized, it becomes possible to peep and observe into the water, while floating on the water surface. Also, when the face is pushed against a face pushing-against part 5 of the see-through member 4, not only it becomes very convenient to peep and observe into the water but also it becomes possible to execute a play such as wave-passing, etc., and in the case of lying on the back, it displays a function as a pillow, as well. Even a person who is a poor hand at swimming can exercise swimming such as a crawl, the breaststroke, the backstroke, etc., and by only inserting the arm into the opening part 3, it also possible to enjoy a play without any anxiety.

German Patent Number DE19617720

Inventor: Spichalski Bartosch

Issued: Nov. 6, 1997

The floating body (1), which is best in the form of a triangular foam board, has rods (2,3) joined by a connector (4) to a cord (5) pulled through an opening at the point of the body, and on the other side are equipped with floating elements (6). In the assembled state the floating elements for an extension of the floating body. Handles in the form of elongated holes are located on both sides of the axial opening in the floating body and on the outer edges of the floating elements.

French Patent Number FR2751610

Inventor: Paul Cosnefroy

Issued: Jan. 30, 1998

A floating board, designed to be towed by a powered craft, consists of a platform (1) covering at least half its length for a person to lie or kneel on, and a rotary panel (3) at its forward end (2) connected to a rudder on the underside. The panel sits in a recess (7), turns about a pivot (6) and has two handles (5) for the passenger to grip and turn it. The forward section (2) of the platform is raised; it also has two lengthwise side members and two fins on the underside. It is made from polyester, with the top of the platform covered with polyurethane foam. The board has an overall length of 1600 mm and a width of 600 mm.

While these aquatic exercise devices may be suitable for the purposes for which they were designed, they would not be as suitable for the purposes of the present invention, as hereinafter described.

SUMMARY OF THE PRESENT INVENTION

A primary object of the present invention is to provide an aquatic exercise device comprising a floating mat having handles and resistance elements that enable a user to perform exercises involving the lifting of ones legs or swinging from side to side while in an aquatic environment.

Another object of the present invention is to provide an aquatic exercise device having handles on both sides to allow for use on either side of the device.

Yet another object of the present invention is to provide an aquatic exercise device having Plexiglas® resistance elements to stabilize the device while performing an exercise.

Still yet another object of the present invention is to provide an aquatic exercise device Another object of the present invention is to provide an aquatic exercise device having an extending form to accommodate all body sizes of users.

Yet another object of the present invention is to provide an aquatic exercise device having an enlarged distal portion to provide support to the user when used for floatation.

Additional objects of the present invention will appear as the description proceeds.

The present invention overcomes the shortcomings of the prior art by providing an aquatic exercise device used to present a stable floating platform having a plurality of handles, and stabilizers that enable a user to perform exercises where on may lift their legs and/or swing there legs side to side while grasping the device in the water.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

LIST OF REFERENCE NUMERALS

Figure 1:
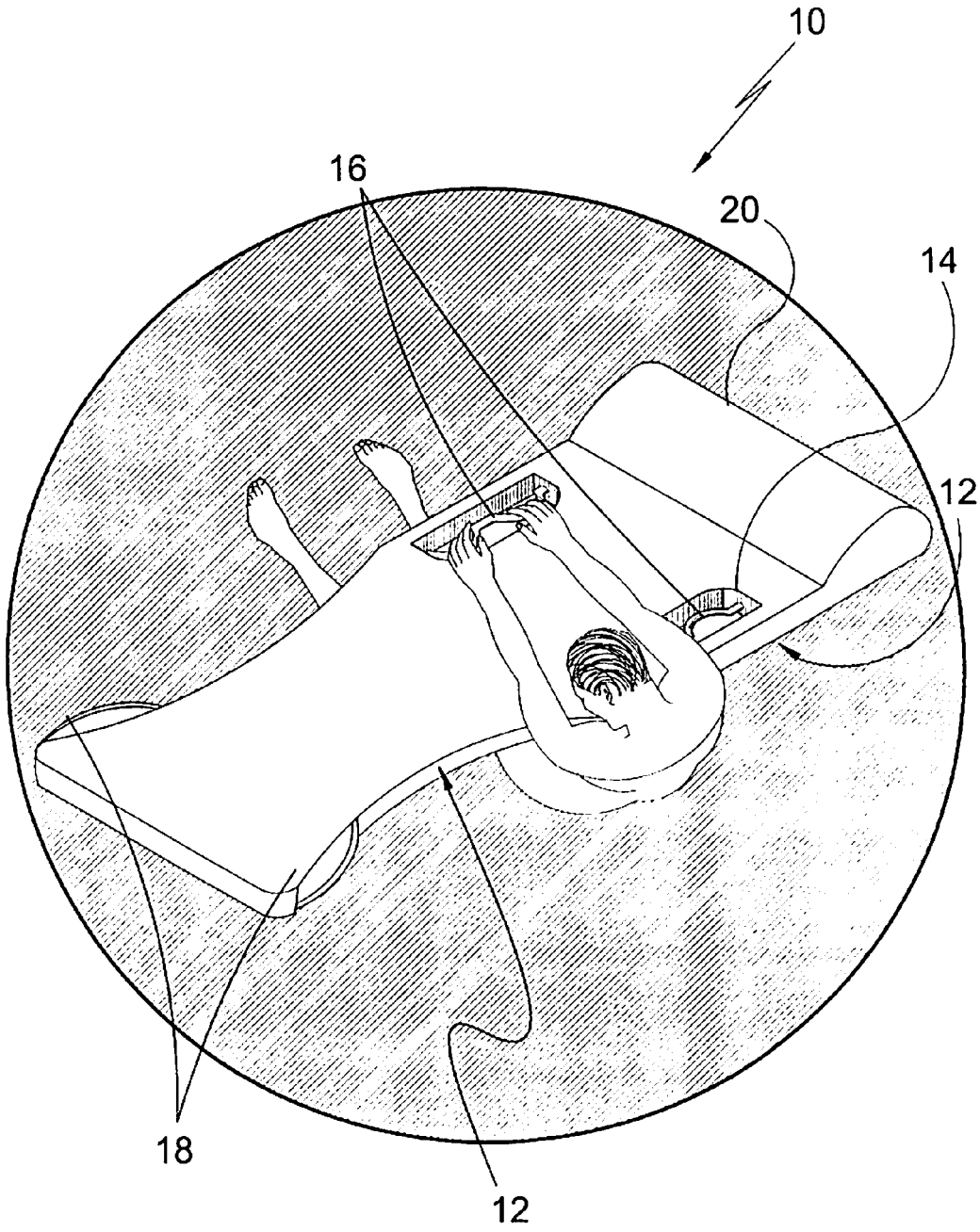
FIG. 1 is an illustrative view of the present invention in use.

With regard to reference numerals used, the following numbering is used throughout the drawings.

10 Present Invention
12 Exercise Mat
14 Aperture
16 Handle
18 Resistance Wing
20 Head Rest
22 Triangular Resistance Wing
24 Semicircular Resistance Wing
26 Rectangular Resistance Wing
28 Square Resistance Wing

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

Figure 2:
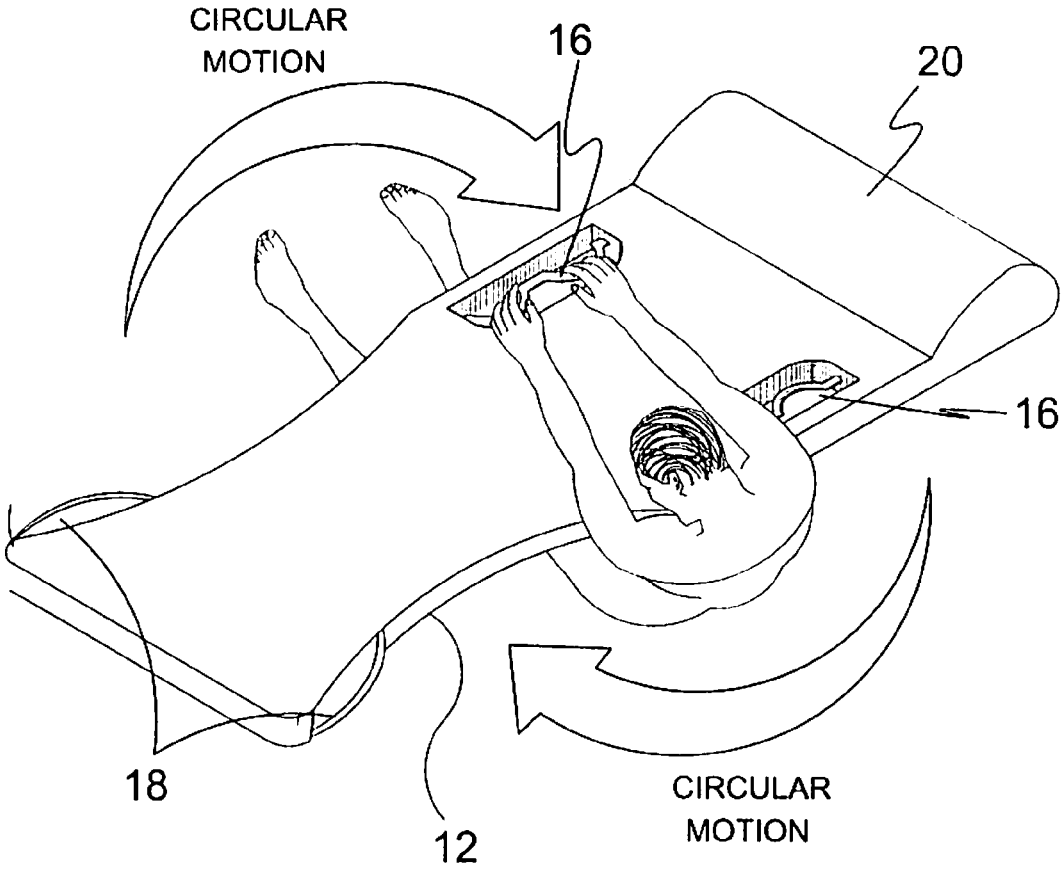
FIG. 2 is an illustrative view of the present invention in use.
Figure 3:
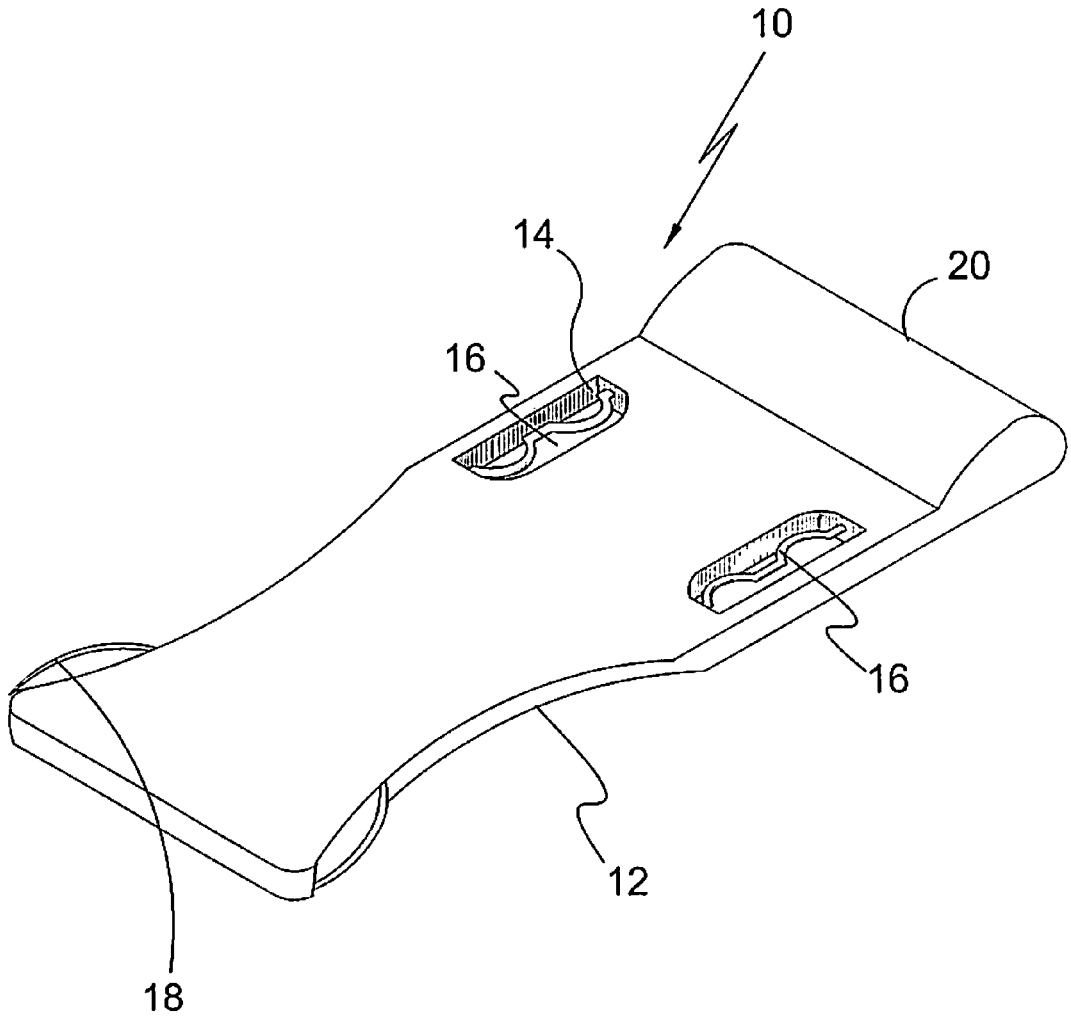
FIG. 3 is a perspective view of the present invention.
Figure 4:
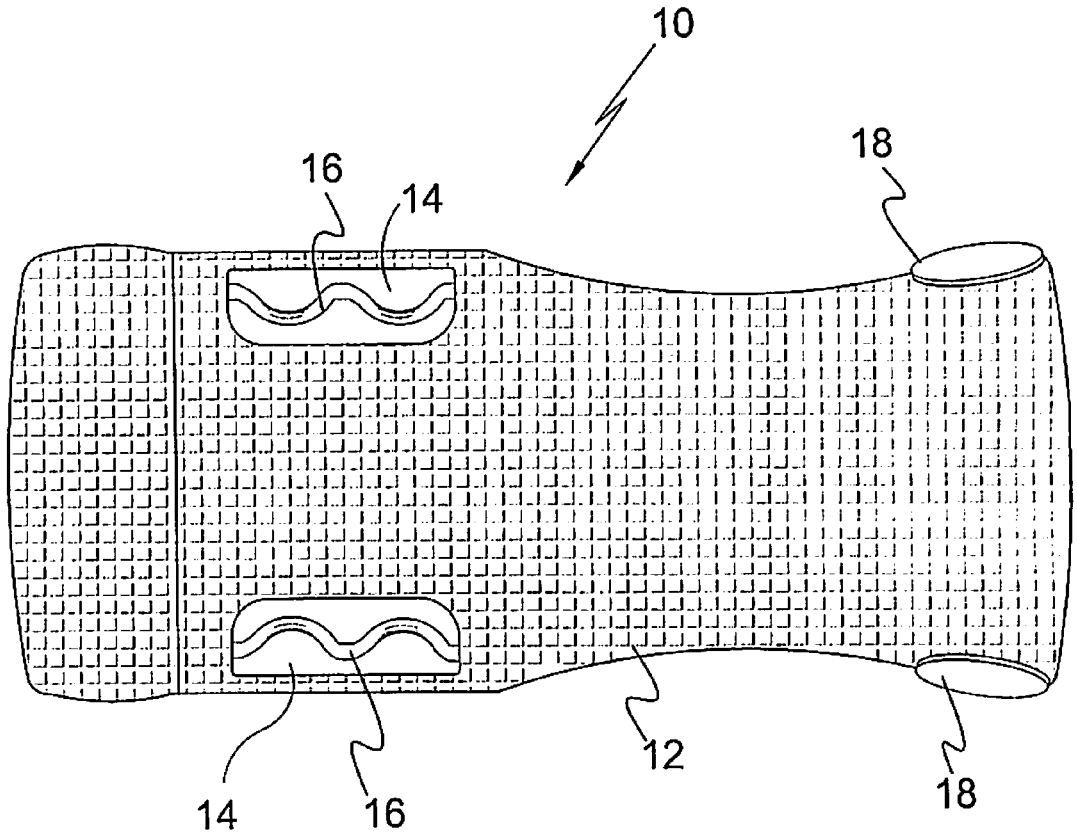
FIG. 4 is a top view of the present invention.
Figure 9:
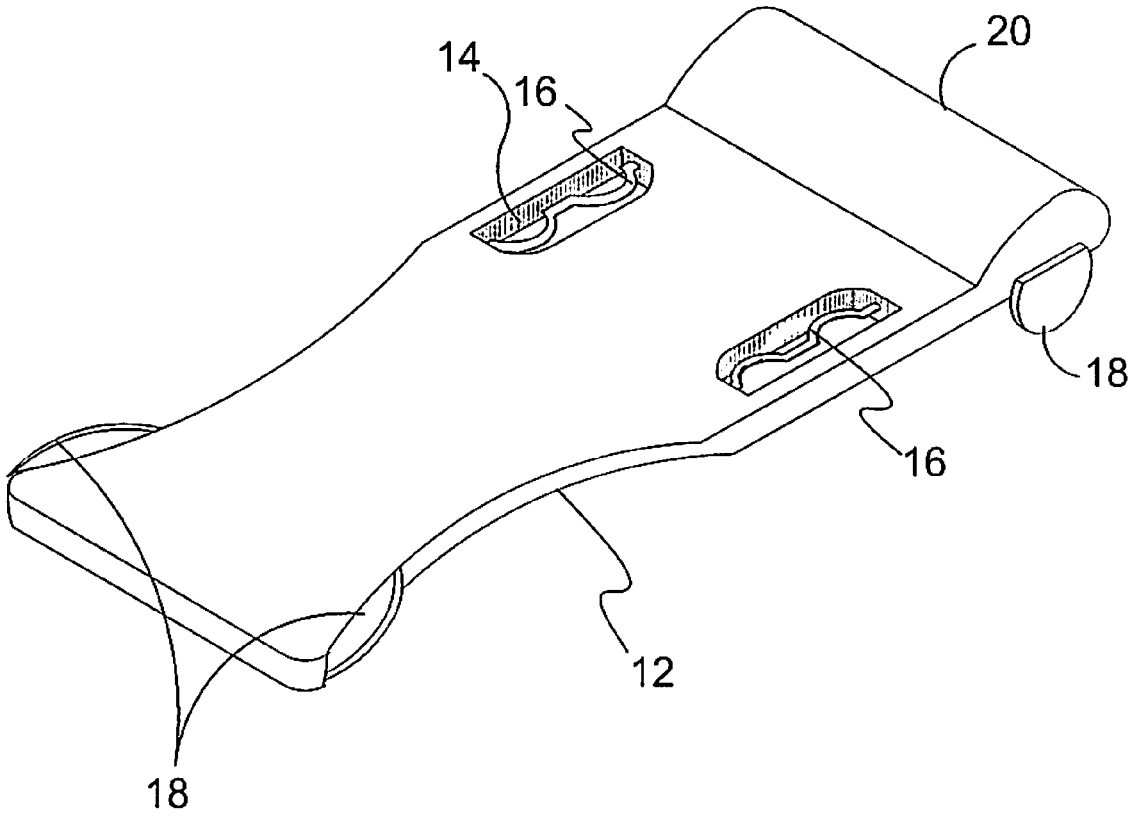
FIG. 9 is a perspective view of the present invention.

FIG. 1 is an illustrative view of the present invention in use. The present invention is a floatation exercise mat. The mat is made of a buoyant material and is provided with apertures. The apertures have handles located therein for the user to grasp so that user can use the mat to remain afloat while performing aquatic exercises. The floatation exercise mat has resistance wings or stabilizers extending there from to steady the mat during use. As seen in FIG. 2, the user can move their legs and torso under the mat in a side-to-side motion or in circular motion to work the abdominal and oblique muscles. The circular exercises would be performed in both clockwise and counter clockwise directions. The user may also perform leg raises that utilize the natural resistance of the water. In addition the user may work their leg muscles by holding onto the mat while lying in a face down prone position and kicking their legs. The user would typically perform a scissors kick as if they were swimming the breaststroke. The inherent buoyancy of mat maintains the user afloat during the exercises. Shown on the end of the mat are polycarbonate resistance wings, which provide resistance to the motion of the user, and so that the mat does not freely spin or rotate while the user is performing their exercises. FIG. 3 shows a perspective view of the present invention. From this view it is easy to see an aperture is disposed on each side of the mat and each aperture has a handle disposed therein. The body of the mat is has three sections, a proximal section which includes the apertures with handles. This section supports the users torso while the user lies on mat. The proximal section of the mat has a head secured thereto to support the head of a user while the user lies on the mat. The intermediate section is tapered and narrower than proximal section. The distal section is wider than the intermediate section and supports the feet of the user. The distal section supports the resistance wings. Resistance wings may be added to the sides of the headrest to provide the mat with more stabilization (see FIG. 9). In FIG. 9 a resistance wing is shown attached to the side of the headrest. There is another resistance secured to the other side of the headrest. It is not visible in this Figure. FIG. 4 shows how the top of the mat may be textured to make it easer for the user to stay on the mat.

Figure 5:
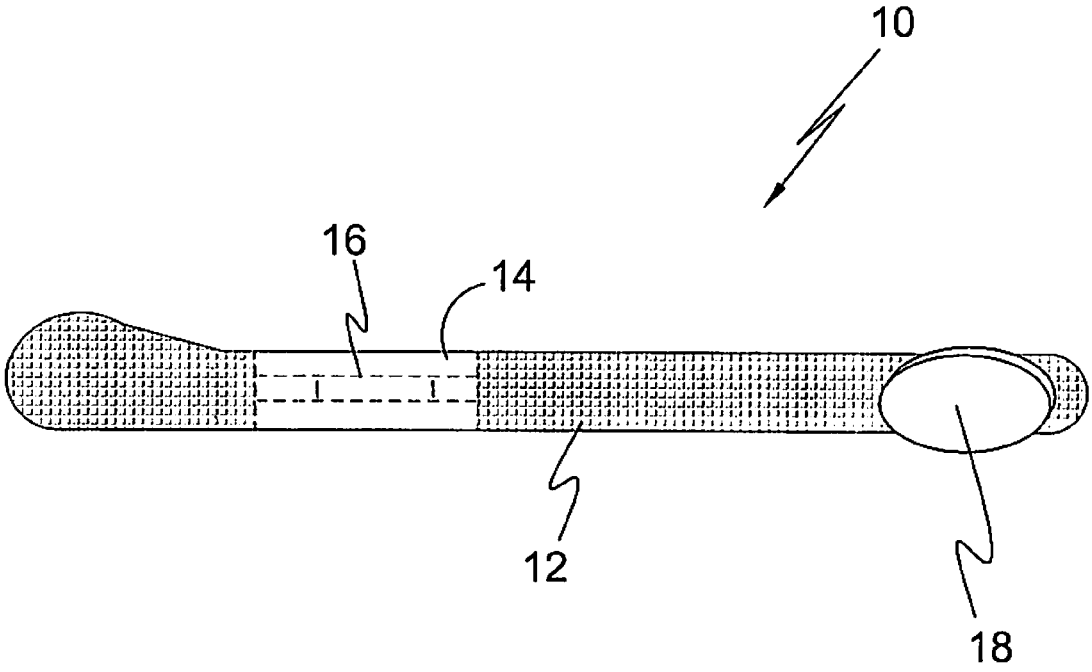
FIG. 5 is a side view of the present invention.
Figure 6:
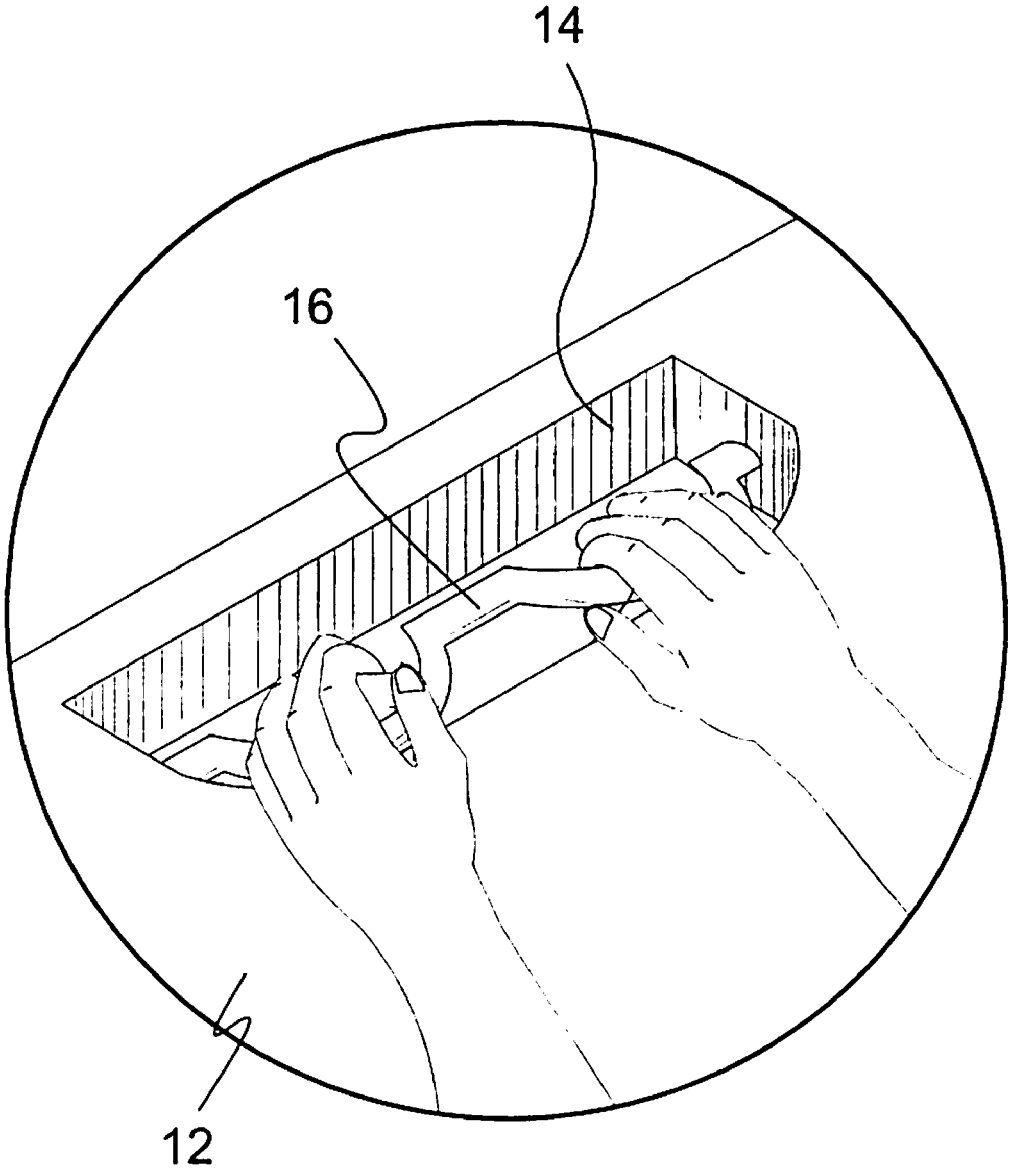
FIG. 6 is a detailed view of the present invention.
Figure 7:
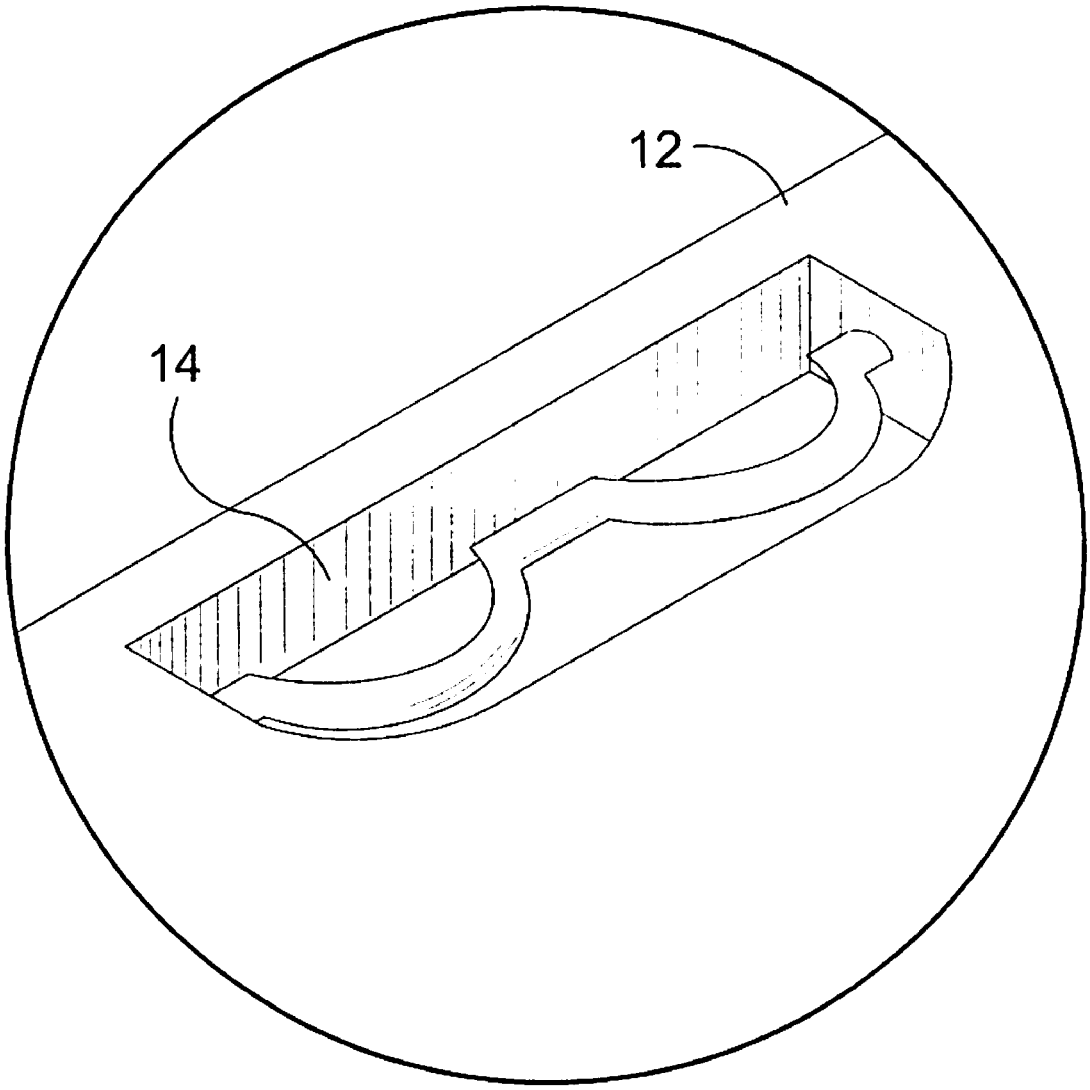
FIG. 7 is a detailed view of the present invention.

Looking at FIG. 5 it becomes clear that the handles are approximately centered in the thickness of the mat. This makes the mat comfortable to lie upon when not in use as an exercise device. The user will be able to lie on the mat for leisure floating and not feel the handles on their body. Looking at FIGS. 6 and 7 the detail of the handles becomes clear. Each of the handles has an end that is secured in the body of the mat. The handle has two grooved or curved section, one for each hand of the user. Typically, as seen in FIGS. 1 and 2, the user grasps the handle on the opposite side of the mat. Thus the grooves face the edge of the mat closest to the aperture. This provides the user with a smooth gripping surface when gripped across the mat. It is desired that the handles be made of lightweight material that is strong and durable which is capable of withstanding the chlorinated water, which is found in most pools. The handles may be formed of nylon, rigid polypropylene, rigid polyethylene or other suitable rigid plastics. It has been contemplated that gripping surfaces of the handles may be coated to provide the user with a more comfortable gripping surface as well as to provide a surface that is easier to grasp in a wet environment. It is envisioned that the gripping surfaces may be coated with a natural rubber, artificial rubber, silicone, thermo plastic elastomer, or any other suitable plastic, which provides the proper gripping surface. This coating can be applied to the handles by bonding, dipping, or injection molding where the handles are placed into a mold and the coating is injected about the handle to provide the desired layer.

Figure 8:
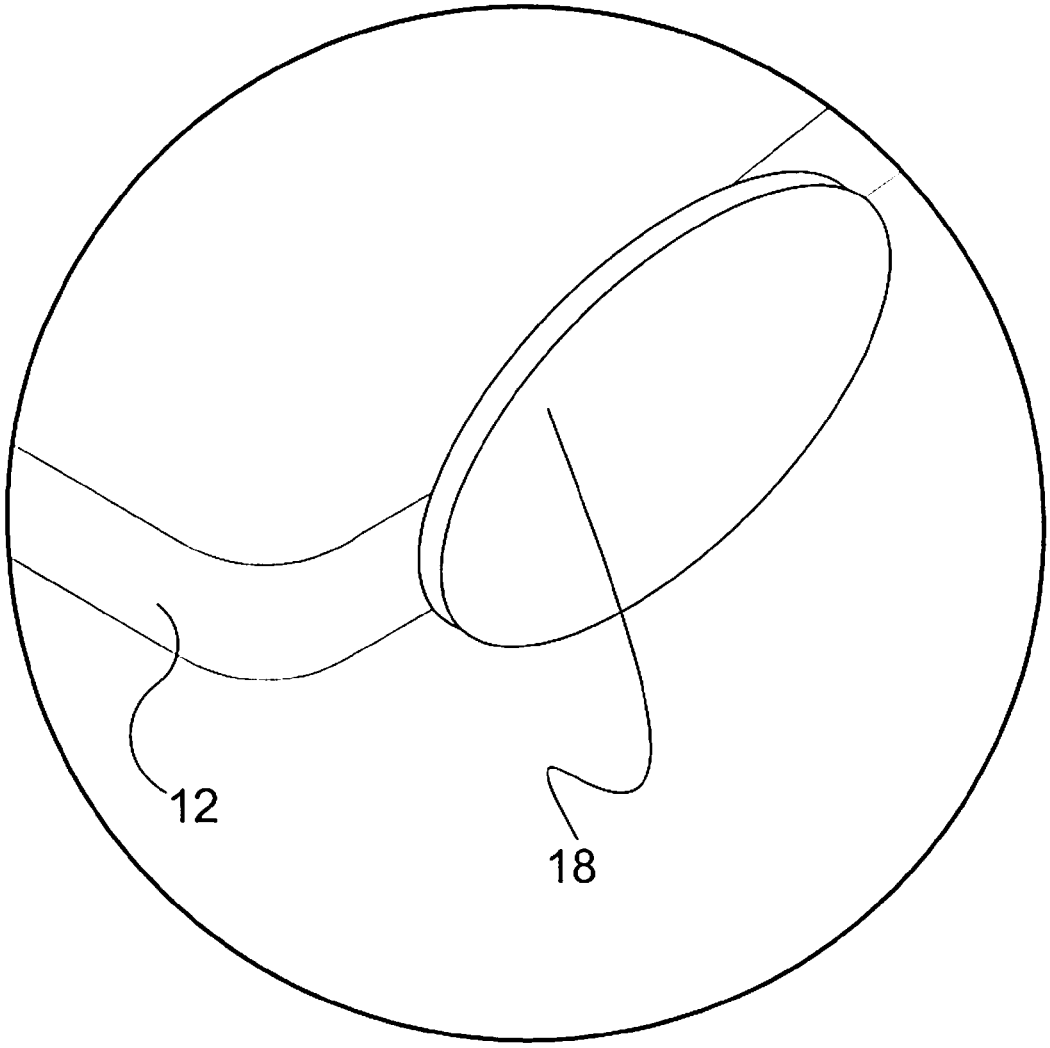
FIG. 8 is a detailed view of the present invention.
Figure 8A:
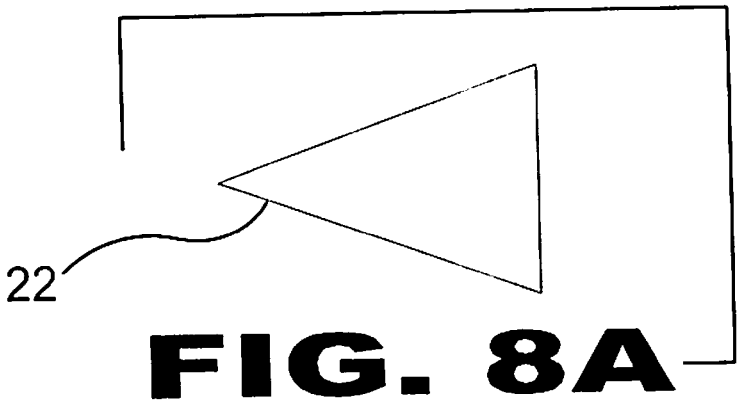
FIG. 8A is a detailed view of a triangular resistance wing.
Figure 8B:
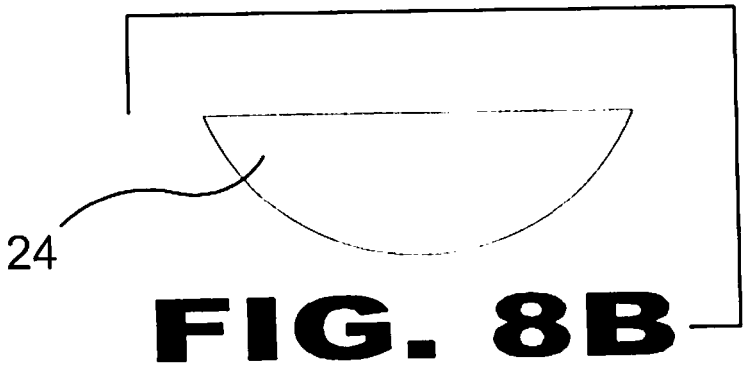
FIG. 8B is a detailed view of a semicircular resistance wing.
Figure 8C:
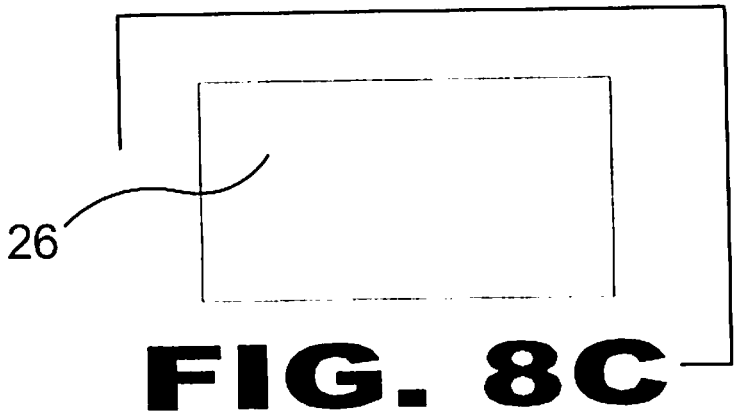
FIG. 8C is a detailed view of a rectangular resistance wing.
Figure 8D:
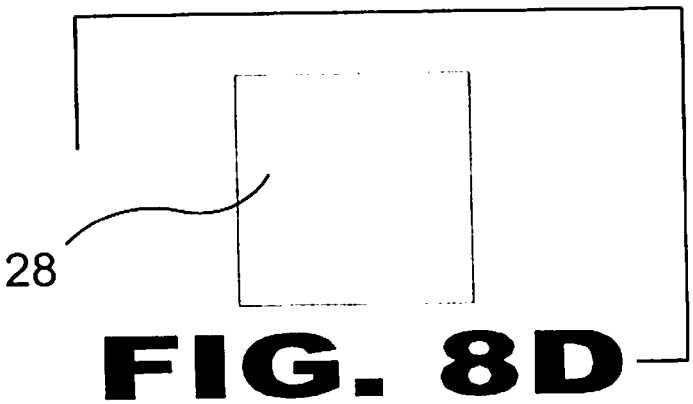
FIG. 8D is a detailed view of a square resistance wing.

FIG. 8 shows a detailed view of a resistance wing. These wings are typically made of a polycarbonate, which is commonly referred to as Plexiglas®. The wing is shown with an oval shape but other shapes are also possible. The wings could be triangular 22, semicircular 24, rectangular 26, or square 28 (see FIGS. 8A-8D). The wings shown in FIGS. 8A-8D have sharp corners. The wings could be provided with rounded corners to protect the user. As seen in FIG. 8, the wings are shown as being approximately centered in the thickness of the mat where they extend above and below the mat surface equal amounts. They could also be positioned on the mat such that they are flush with the upper or top surface of the mat. This would make the mat one sided where the mat would have to be placed in the water top surface up so that the resistance wings make contact with the water to perform their resistance function. Locating the resistance wings flush with the top surface provides greater resistance for the user to prevent the turning when the user is performing the exercises previously disclosed. The resistance wings would provide more resistance more since a larger amount of the wing surfaces would be in contact with the water. It has been contemplated that the mat be formed of a highly buoyant foamed plastic material. The material may be a foamed polyethylene or polypropylene or combinations of the two. The material can be closed or open cell foam depending upon on the amount of buoyancy desired.

I claim:

1. A method of exercising in a body of water comprising the steps of:

placing an exercise mat in a body of water, said mat comprising a substantially planar, unarticulated, single piece elongated body of buoyant construction, with a pair of apertures adjacent opposite sides of said body with a handle comprising a rod shaped member secured to said mat within each aperture, each said handle extending from one side of each aperture to an opposite side of each aperture parallel to side edges of said mat with space between each handle and a side wall of said aperture for grasping each handle within an aperture, each handle having side by side looped sections forming a "w" shape, neither handle extending above or below top or bottom surfaces of said mat, said mat having a resistance wing on each side thereof the resistance wings functioning to steady the mat during use so it does not freely spin or rotate while the user is performing exercise; and a user grasping a handle with both hands on a single handle, with each hand grasping a different looped section of said single handle extending from an opposite side of said mat by stretching arms across a top surface of said mat at substantially a right angle to a longitudinal axis of said mat for engaging in an exercise wherein the user moves legs and torso hanging under the mat in the body of water from a side edge of said mat in a side-to-side motion or in circular motion to exercise abdominal and oblique muscles.

* * * * *